US011187105B2

(12) United States Patent
Hafner et al.

(10) Patent No.: US 11,187,105 B2
(45) Date of Patent: Nov. 30, 2021

(54) APPARATUS WITH THERMAL BREAK

(71) Applicant: GENERAL ELECTRIC COMPANY, Schenectady, NY (US)

(72) Inventors: Matthew Troy Hafner, Honea Path, SC (US); Jason Robert Parolini, Greer, SC (US); Canan Uslu Hardwicke, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 923 days.

(21) Appl. No.: 15/428,462

(22) Filed: Feb. 9, 2017

(65) Prior Publication Data

US 2018/0223689 A1 Aug. 9, 2018

(51) Int. Cl.

| | |
|---|---|
| ***F01D 5/28*** | (2006.01) |
| ***F01D 25/14*** | (2006.01) |
| ***F23R 3/00*** | (2006.01) |
| ***F01D 5/14*** | (2006.01) |
| *F01D 9/02* | (2006.01) |

(Continued)

(52) U.S. Cl.

CPC ..... *F01D 25/14* (2013.01); *F01D 5/147* (2013.01); *F01D 5/284* (2013.01); *F23R 3/002* (2013.01); *F23R 3/007* (2013.01); *F01D 5/187* (2013.01); *F01D 9/023* (2013.01); *F01D 9/065* (2013.01); *F05D 2240/81* (2013.01); *F05D 2260/20* (2013.01); *F05D 2300/6033* (2013.01); *F23R 2900/00018* (2013.01)

(58) Field of Classification Search

CPC ..... F01D 5/284; F05D 2300/6033

See application file for complete search history.

(56) References Cited

U.S. PATENT DOCUMENTS 4,613,280 A * 9/1986 Tate ..... F01D 11/005 415/110

5,363,643 A * 11/1994 Halila ..... F23R 3/007 60/796

(Continued)

FOREIGN PATENT DOCUMENTS

EP 0225527 A2 * 6/1987 ..... F02K 1/822

OTHER PUBLICATIONS

Musgrave, Gary Eugene Larsen, Axel M. Sgobba, Tomasso. (2009). Safety Design for Space Systems, Elsevier, pp. 597-598. Retrieved from https:l/app.knovel.com/hotlink/pdffid:kt006S2PBJ/safety-design-spacesystems/ (Year: 2009).*

(Continued)

*Primary Examiner* — Gerald L Sung
*Assistant Examiner* — Marc J Amar
(74) *Attorney, Agent, or Firm* — McNees Wallace & Nurick LLC

(57) ABSTRACT

An apparatus is disclosed, including a first article, a second article, at least one interface structure, and a thermal break directly adjacent to the at least one interface structure. The first article includes a first material composition having a first thermal tolerance. The second article includes a second material composition having a second thermal tolerance greater than the first thermal tolerance. The first article and the second article are in contact with one another through the interface structure. The thermal break interrupts a thermal conduction path from the second article to the first article.

17 Claims, 4 Drawing Sheets

(51) Int. Cl.
*F01D 9/06* (2006.01)
*F01D 5/18* (2006.01)

(56) References Cited

U.S. PATENT DOCUMENTS 5,782,294 A * 7/1998 Froemming ..... F01D 11/005 165/168
6,573,474 B1 * 6/2003 Loringer ..... B23K 26/384 219/121.71
6,758,653 B2 * 7/2004 Morrison ..... F01D 9/04 415/116
7,908,867 B2 * 3/2011 Keller ..... F01D 9/023 415/173.4
10,047,958 B2 * 8/2018 Erbas-Sen ..... F23R 3/002
2003/0175122 A1 * 9/2003 Zhao ..... F01D 5/18 416/241 B
2003/0207155 A1 * 11/2003 Morrison ..... C04B 35/80 428/699
2006/0207259 A1 * 9/2006 Holt ..... F23M 5/085 60/772
2007/0144178 A1 * 6/2007 Burd ..... F23R 3/007 60/753
2009/0071160 A1 * 3/2009 Keller ..... F01D 9/023 60/753
2012/0073304 A1 * 3/2012 Butkiewicz ..... F01D 9/023 60/772
2012/0227389 A1 * 9/2012 Hinderks ..... F01B 1/10 60/317
2013/0004306 A1 * 1/2013 Albers ..... F01D 25/246 415/200
2013/0019603 A1 * 1/2013 Dierberger ..... F23R 3/06 60/772
2014/0093379 A1 * 4/2014 Tibbott ..... F01D 5/188 416/224
2014/0130504 A1 * 5/2014 Chen ..... F01D 25/12 60/772
2014/0154088 A1 * 6/2014 Etter ..... B22F 10/20 416/223 R
2014/0360196 A1 * 12/2014 Graves ..... F23R 3/007 60/753
2015/0184522 A1 * 7/2015 Smith ..... F01D 5/187 416/96 R
2015/0240724 A1 * 8/2015 Low ..... F02C 7/28 60/722
2015/0377050 A1 * 12/2015 Freeman ..... F01D 11/005 416/185
2015/0377069 A1 12/2015 Landwehr et al.
2016/0084092 A1 * 3/2016 Cairo ..... F01D 9/02 428/137
2016/0160660 A1 6/2016 Shi et al.
2016/0222806 A1 * 8/2016 Jennings ..... F01D 5/284
2016/0258311 A1 * 9/2016 Varney ..... F01D 11/08
2016/0376893 A1 * 12/2016 Hardwicke ..... C04B 37/005 156/249
2017/0059159 A1 * 3/2017 Varney ..... C04B 41/81
2017/0204736 A1 * 7/2017 Varney ..... F01D 11/24
2017/0248029 A1 * 8/2017 Hafner ..... F01D 9/041
2018/0194688 A1 * 7/2018 Hafner ..... C04B 35/806
2018/0223680 A1 * 8/2018 Hafner ..... F01D 9/042
2018/0292090 A1 * 10/2018 Dyer ..... F23R 3/60
2019/0085707 A1 * 3/2019 Xu ..... F01D 5/186
2019/0101027 A1 * 4/2019 Lepretre ..... F01D 25/243
2019/0136707 A1 * 5/2019 Palmer ..... B22F 10/20 416/223 R
2019/0285271 A1 * 9/2019 Lee ..... B01J 37/03

OTHER PUBLICATIONS

Gardiner, Ginger, Aeroengine Composites, Part 1: The CMC invasion, Jul. 31, 2015, https://www.compositesworld.com/articles/aeroengine-composites-part-1-the-cmc-invasion, p. 3. (Year: 2015).*
Mouritz, Adrian, Introduction to Aerospace Materials, 2012, Woodhead Publishing, first ed., p. 257. (Year: 2012).*
Hafner, et al.; "Apparatus, Turbine Nozzle and Turbine Shroud", filed on Feb. 26, 2016 as U.S. Appl. No. 15/054,346 (not yet published).

* cited by examiner

APPARATUS WITH THERMAL BREAK

FIELD OF THE INVENTION

The present invention is directed to apparatuses with thermal breaks. More particularly, the present invention is directed to apparatuses with thermal breaks adjacent to interface structures between material compositions with different thermal tolerances.

BACKGROUND OF THE INVENTION

Gas turbines are continuously being modified to provide increased efficiency and performance. These modifications include the ability to operate at higher temperatures and under harsher conditions, which often requires material modifications and/or coatings to protect components from such temperatures and conditions. As more modifications are introduced, additional challenges are realized.

One modification to increase performance and efficiency involves forming gas turbine components, such as nozzles (also known as vanes), buckets (also known as blades), shrouds, combustors, combustion liners, transition pieces, and exhaust frames, at least partially from ceramic matrix composites ("CMC"). However, where CMC materials contact metal alloys, such as iron-based alloys, steels, carbon steels, stainless steels, nickel-based alloys, cobalt-based alloys, titanium-based alloys, titanium-aluminum alloys, refractory alloys, superalloys, iron-based superalloys, nickel-based superalloys, and cobalt-based superalloys, undesirable interactions may occur between the CMC and the metal alloy at elevated temperatures. By way of example, where a metal alloy contacts CMC, silicides may form at temperatures above about 1,500° F., and silicides may rapidly degrade the metal alloy.

BRIEF DESCRIPTION OF THE INVENTION

In an exemplary embodiment, an apparatus includes a first article, a second article, at least one interface structure, and a thermal break directly adjacent to the at least one interface structure. The first article includes a first material composition having a first thermal tolerance. The second article includes a second material composition having a second thermal tolerance greater than the first thermal tolerance. The first article and the second article are in contact with one another through the interface structure. The thermal break interrupts a thermal conduction path from the second article to the first article.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
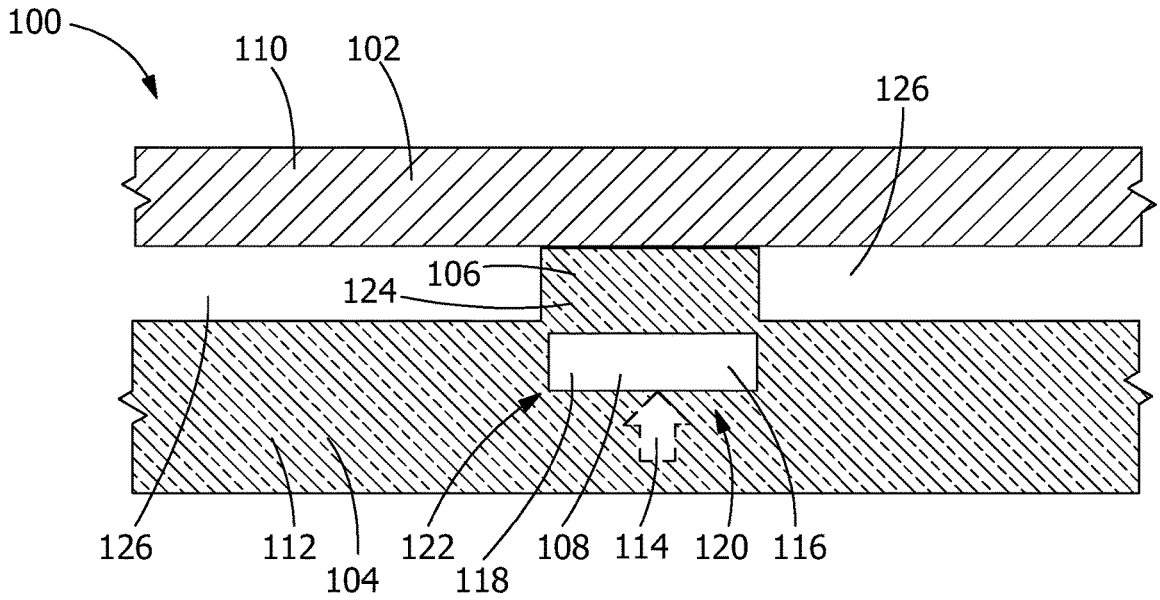
FIG. 1 is a sectional view of an apparatus with the second article defining the thermal break, according to an embodiment of the present disclosure.

Provided are exemplary apparatuses with thermal breaks. Embodiments of the present disclosure, in comparison to articles and methods not utilizing one or more features disclosed herein, decrease costs, increase part life, decrease silicide attack on metal alloys, increase efficiency, reduce cooling requirements, or a combination thereof.

Referring to FIGS. 1-5, in one embodiment, an apparatus 100 includes a first article 102, a second article 104, at least one interface structure 106, and a thermal break 108 directly adjacent to the at least one interface structure 106. The first article 102 includes a first material composition 110 having a first thermal tolerance. The second article 104 includes a second material composition 112 having a second thermal tolerance greater than the first thermal tolerance. The first article 102 and the second article 104 are in contact with one another through the interface structure 106. The thermal break 108 interrupts a thermal conduction path 114 from the second article 104 to the first article 102.

The apparatus 100 may be any suitable device or article, including, but not limited to, a turbine component. Suitable turbine components may include, but are not limited to, nozzles, buckets, shrouds, combustors, combustion liners, transition pieces, exhaust frames, or combinations thereof.

In one embodiment, the first material composition 110 is a metal. The metal may be any suitable alloy, including, but not limited to, iron-based alloys, steels, carbon steels, stainless steels, 9Cr-12Cr stainless steels, nickel-based alloys, cobalt-based alloys, titanium-based alloys, titanium-aluminum alloys, refractory alloys, superalloys, iron-based superalloys, nickel-based superalloys, cobalt-based superalloys, 304SS, 310SS, 410SS, GTD-111, HR-120, INCONEL 718, René N5, René 108, or combinations thereof.

As used herein, "304SS" refers to an alloy including a composition, by weight, of about 19% chromium, about 10% nickel, and a balance of iron.

As used herein, "310 SS" refers to an alloy including a composition, by weight, of about 25% chromium, about 20.5% nickel, and a balance of iron.

As used herein, "410 SS" refers to an alloy including a composition, by weight, of about 12.5% chromium and a balance of iron.

As used herein, "GTD-111" refers to an alloy including a composition, by weight, of about 14% chromium, about 9.5% cobalt, about 3.8% tungsten, about 4.9% titanium, about 3% aluminum, about 0.1% iron, about 2.8% tantalum, about 1.6% molybdenum, about 0.1% carbon, and a balance of nickel.

As used herein, "HR-120" refers to an alloy including a composition, by weight, of about 25% chromium, about 37% nickel, up to about 3% cobalt, about 0.1% aluminum, up to about 2.5% tungsten, up to about 2.5% molybdenum, about 0.7% niobium, about 0.7% manganese, about 0.6% silicon, about 0.2% nitrogen, and a balance of iron.

As used herein, "INCONEL 718" refers to an alloy including a composition, by weight, of about 0.08% carbon, about 19% chromium, about 1% cobalt, about 3% molybdenum, about 0.35% manganese, about 1% titanium, about 0.5% copper, about 0.5% aluminum, about 0.35% silicon, about 5% niobium, about 5.25% nickel, and a balance of iron.

As used herein, "René 108" refers to an alloy including a composition, by weight, of about 8.4% chromium, about 9.5% cobalt, about 5.5% aluminum, about 0.7% titanium, about 9.5% tungsten, about 0.5% molybdenum, about 3% tantalum, about 1.5% hafnium, and a balance of nickel.

As used herein, "René N5" refers to an alloy including a composition, by weight, of about 7.5% cobalt, about 7.0% chromium, about 6.5% tantalum, about 6.2% aluminum, about 5.0% tungsten, about 3.0% rhenium, about 1.5% molybdenum, about 0.15% hafnium, and a balance of nickel.

As used herein, "9Cr-12Cr stainless steel" refers to stainless steel alloys including, by weight, between about 9% chromium to about 12% chromium. 9Cr-12Cr stainless steels may include, but are not limited to, Cr—Mo—V—Nb—B—Fe stainless steels, Cr—Mo—V—W—Nb—B—Fe stainless steels, and stainless steels including, by weight, up to about 0.4% carbon, up to about 0.2% manganese, up to about 0.2% silicon, up to about 2% nickel, about 9-12% chromium, up to about 2.5% molybdenum, up to about 2% niobium, up to about 0.35% vanadium, up to about 2% tungsten, up to about 100 ppm nitrogen, up to about 200 ppm boron, and a balance of iron. 9Cr-12Cr stainless steels may further include residual elements such as phosphorous and sulfur.

In one embodiment, the second material composition 112 is a CMC. The CMC may be any suitable ceramic composition, including, but not limited to, carbon-fiber-reinforced silicon carbides (C/SiC), silicon-carbide-fiber-reinforced silicon carbides (SiC/SiC), carbon-fiber-reinforced silicon nitrides ($C/Si_3N_4$), and combinations thereof.

The interface structure 106 may include any suitable size, including, but not limited to, a width or diameter of up to about 2 inches, alternatively between about 0.1 to about 2 inches, alternatively, between about 0.2 inches to about 1.5 inches, alternatively between about 0.3 inches to about 1.2 inches, alternatively between about 0.4 inches to about 1.1 inches, alternatively between about 0.5 inches to about 1 inch, alternatively between about 0.25 inches to about 0.5 inches, alternatively between about 0.5 inches to about 0.75 inches, alternatively between about 0.75 inches to about 1 inch, alternatively between about 0.6 inches to about 0.9 inches. The interface structure 106 may include any suitable height, including, but not limited to a height up to about 0.2 inches, alternatively between about 0.01 inches to about 0.2 inches, alternatively between about 0.02 inches to about 0.18 inches, alternatively between about 0.03 inches to about 0.17 inches, alternatively between about 0.04 inches to about 0.16 inches, alternatively between about 0.05 inches to about 0.15 inches, alternatively between about 0.05 inches to about 0.1 inches, alternatively between about 0.075 inches to about 0.125 inches, alternatively between about 0.125 inches to about 0.15 inches, alternatively about 0.1 inches.

In one embodiment, the thermal break 108 includes a hollow feature 116. In another embodiment the thermal break 108 includes an insulator 118. The insulator 118 may be disposed within the hollow feature 116 or may form the hollow feature 116. The insulator may include any suitable composition, including, but not limited to air, static air, flowing air, vacuum, zirconia, silicon nitride, rare earth materials, rare earth oxides, yttria, compressed rare earth oxide powders, or combinations thereof.

The hollow feature 116 may include any suitable cross-sectional conformation 120, including, but not limited to, triangular (not shown), rounded triangular (not shown), rectangular 122, rounded rectangular (not shown), square (not shown), rounded square (not shown), circular (not shown), elliptical (not shown), semi-circular (not shown), semi-elliptical (not shown), or combinations thereof. The hollow feature 116 may include turbulators (not shown), such as, but not limited to, pins, fins, bumps, swirlers, vortex tubes, or combinations thereof.

In one embodiment, the first article 102 directly contacts the second article 104 at the interface structure 106. In a further embodiment, the first material composition 110 directly contacts the second material composition 112 at the interface structure 106. The interface structure 106 may be free of coatings, including, but not limited to thermal barrier coatings and environmental barrier coatings.

Figure 6:
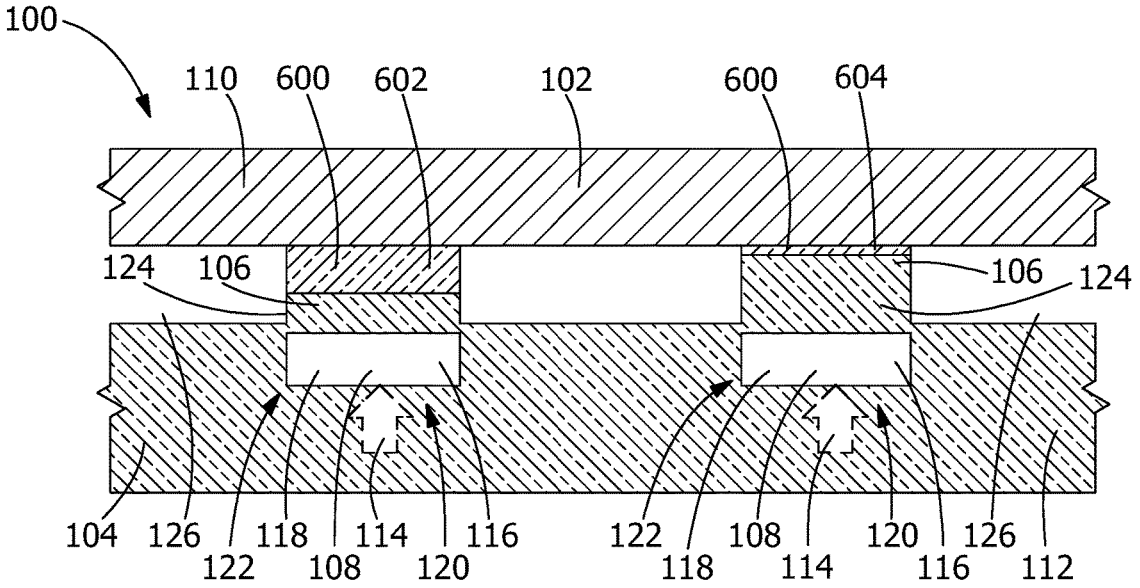
FIG. 6 is a sectional view of the apparatus of FIG. 1 including a barrier material, according to an embodiment of the present disclosure.

Referring to FIG. 6, in one embodiment, the at least one interface structure 106 includes a barrier material 600 disposed between the first article 102 and the second article 104. The barrier material 600 may be any suitable material, including, but not limited to, a ceramic material having less than about 1%, by weight, silicon, a thermal barrier coating material, a yttira-stabilized zirconia, an environmental barrier coating material, or combinations thereof. In one embodiment, the barrier material 600 forms a barrier insert 602. In another embodiment, the barrier material 600 forms a coating 604, such as, but not limited to, a thermal barrier coating, environmental barrier coating, or combinations thereof.

Figure 2:
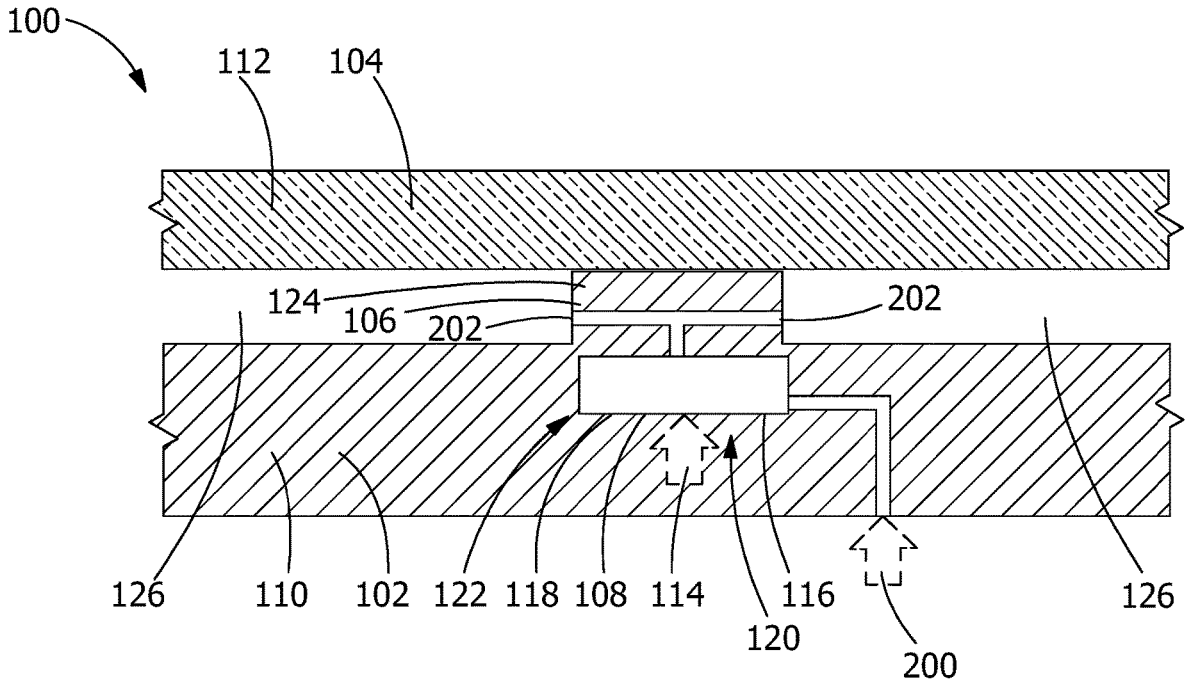
FIG. 2 is a sectional view of an apparatus with the first article defining the thermal break, according to an embodiment of the present disclosure.

Referring to FIGS. 1 and 2, in one embodiment, the thermal break 108 is defined by one of the first article 102 and the second article 104, the thermal break 108 being partitioned from the other of the first article 102 and the second article 104 by a portion 124 of the first article 102 or the second article 104 defining the thermal break 108, the portion 124 constituting the at least one interface structure 106. Referring to FIG. 1, in one embodiment the thermal break 108 is defined by the second article 104, and the thermal break 108 is partitioned from the first article 102 by a portion 124 of the second article 104. Referring to FIG. 2, in one embodiment, the thermal break 108 is defined by the first article 102, and the thermal break 108 is partitioned from the second article 104 by a portion 124 of the first article 102.

Referring to FIG. 2, in one embodiment, the hollow feature 116 is arranged and configured to receive and transmit a flow of a cooling fluid 200. The at least one interface structure 106 may include a plurality of exhaust structures 202 in fluid communication with the hollow feature 116 and a gap 126 between the first article 102 and the second article 104. The plurality of exhaust structures 202 may be arranged and configured to receive the flow of cooling fluid 200 from the hollow feature 116 and exhaust the flow of cooling fluid 200 to the gap 126. Although not shown in FIG. 1, the embodiment depicted in FIG. 1 may also include the plurality of exhaust structures 202 distributing a flow of cooling fluid 200, although in one embodiment, the arrangement of FIG. 1 in which the interface structure 106 is formed from the second material composition 112 is less in need of active cooling than the arrangement of FIG. 2 in which the interface structure 106 is formed from the first material composition 110.

The plurality of exhaust structures 202 may include any suitable conformation, including, but not limited to, cooling holes, cooling slots, cooling channels, or combinations thereof. In one embodiment, wherein the plurality of exhaust structures 202 are cooling holes, the plurality of exhaust structure 202 includes a cross-sectional diameter of between about 0.01 inches to about 0.06 inches, alternatively between about 0.02 inches to about 0.05 inches, alternatively between about 0.01 inches to about 0.02 inches, alternatively between about 0.02 inches to about 0.03 inches, alternatively between about 0.03 inches to about 0.04 inches, alternatively between about 0.04 inches to about 0.05 inches, alternatively between about 0.05 inches to about 0.06 inches, alternatively about 0.03 inches. In another embodiment, wherein the plurality of exhaust structures 202 are cooling channels or cooling slots, the plurality of exhaust structure 202 includes a cross-sectional width of between about 0.02 inches to about 0.3 inches, alternatively between about 0.03 inches to about 0.25 inches, alternatively between about 0.02 inches to about 0.06 inches, alternatively between about 0.06 inches to about 0.1 inches, alternatively between about 0.1 inches to about 0.14 inches, alternatively between about 0.14 inches to about 0.18 inches, alternatively between about 0.18 inches to about 0.22 inches, alternatively between about 0.22 inches to about 0.26 inches, alternatively between about 0.26 inches to about 0.3 inches. In a further embodiment, the plurality of exhaust structures 202 includes a cross-sectional height which, in combination with the cross-section width, provides a cross-sectional area between about 0.001 $in^2$ to about 0.01 $in^2$.

Figure 3:
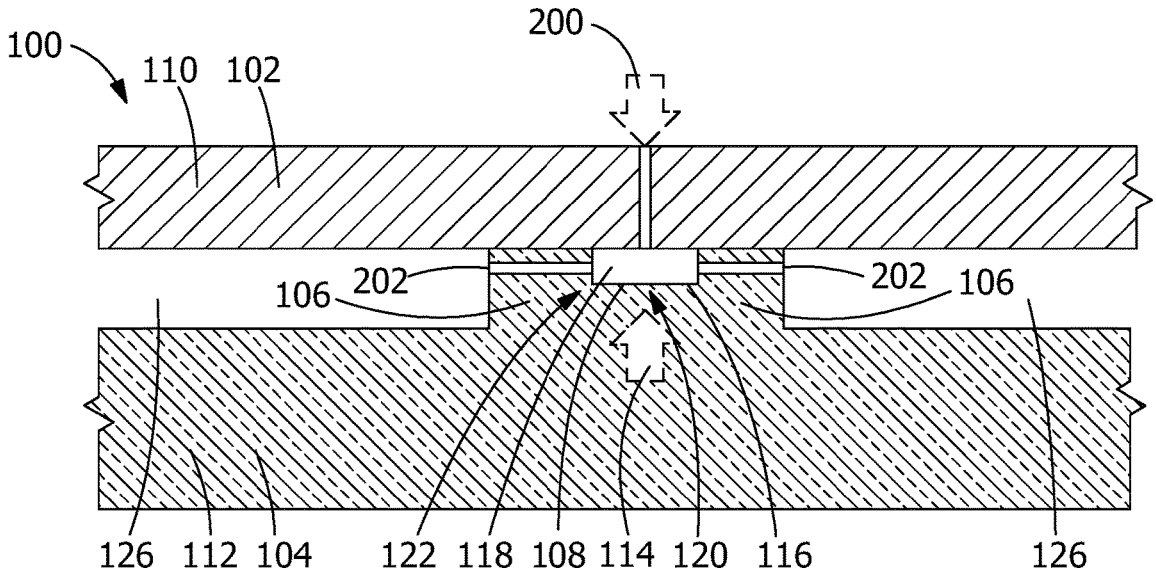
FIG. 3 is a sectional view of an apparatus with the thermal break disposed between the first article and second article and the interface structure protruding from the second article, according to an embodiment of the present disclosure.
Figure 4:
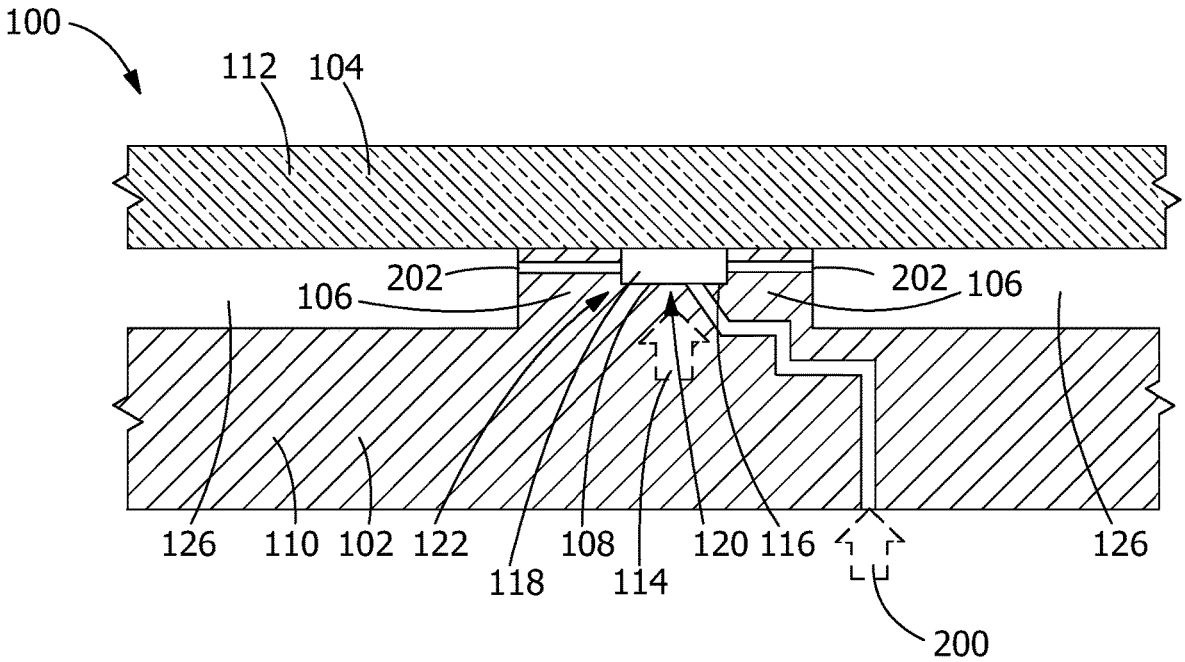
FIG. 4 is a sectional view of an apparatus with the thermal break disposed between the first article and second article and the interface structure protruding from the first article, according to an embodiment of the present disclosure.
Figure 5:
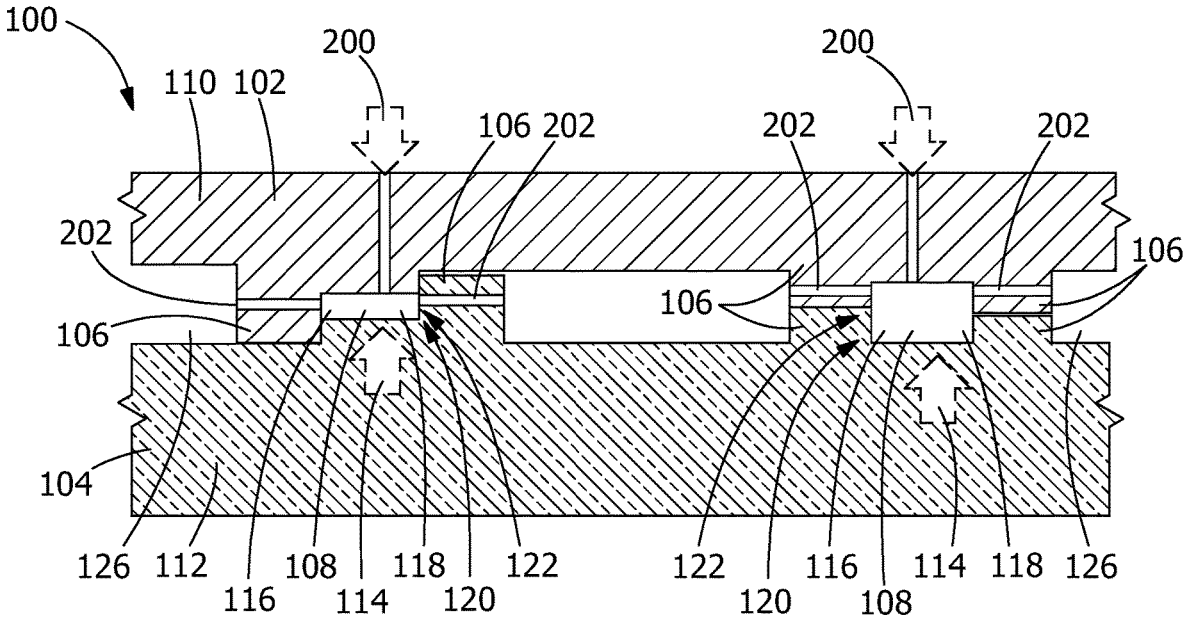
FIG. 5 is a sectional view of an apparatus with the thermal break disposed between the first article and second article and the interface structure protruding from the first and the second article, according to an embodiment of the present disclosure.

Referring to FIGS. 3-5, in one embodiment, the thermal break 108 is disposed between the first article 102 and the second article 104, and the at least one interface 106 structure protrudes from at least one of the first article 102 and the second article 104. The at least one interface structure 106 at least partially surrounding the thermal break 108. The hollow feature 116 may be arranged and configured to receive and transmit a flow of a cooling fluid 200, and the at least one interface structure 106 may include a plurality of exhaust structures 202 in fluid communication with the hollow feature 116 and a gap 126 between the first article 102 and the second article 104. Referring to FIG. 3, in one embodiment, the at least one interface 106 structure protrudes from the second article 104. Referring to FIG. 4, in one embodiment, the at least one interface structure 106 protrudes from the first article 102. Referring to FIG. 5, in yet another embodiment, the at least one interface 106 structure protrudes from both the first article 102 and the second article 104.

Figure 7:
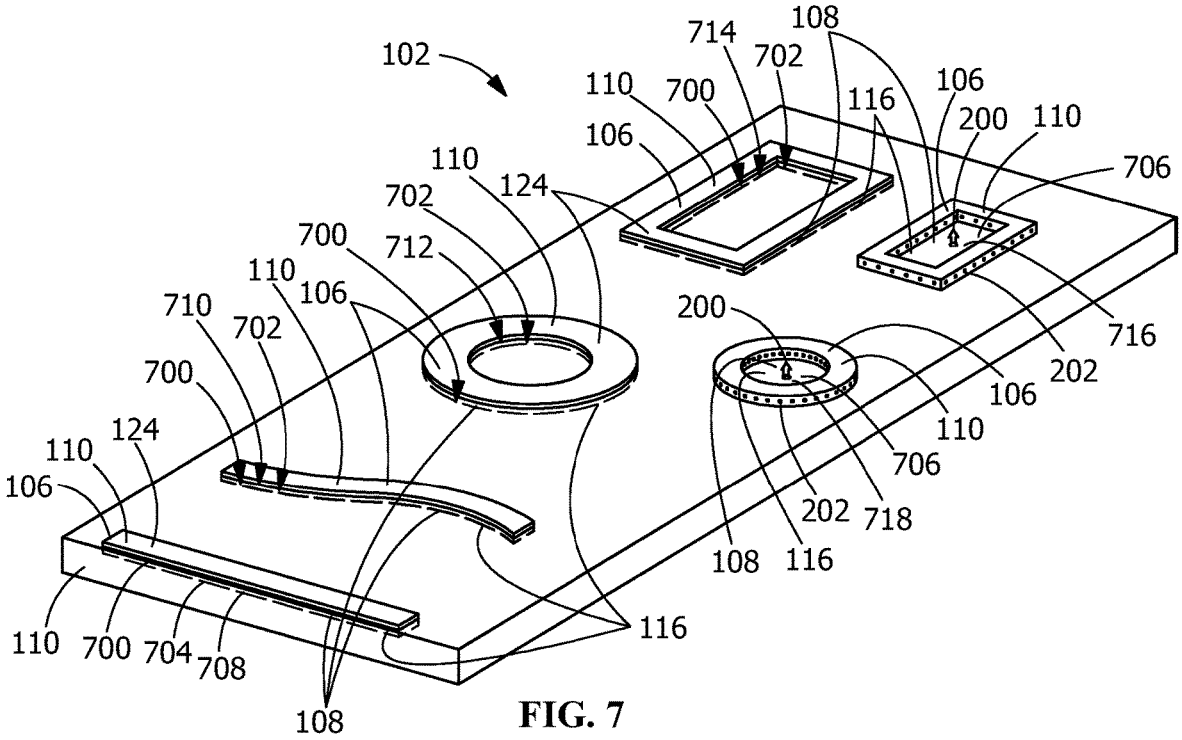
FIG. 7 is a perspective view of the first article, according to an embodiment of the present disclosure.
Figure 8:
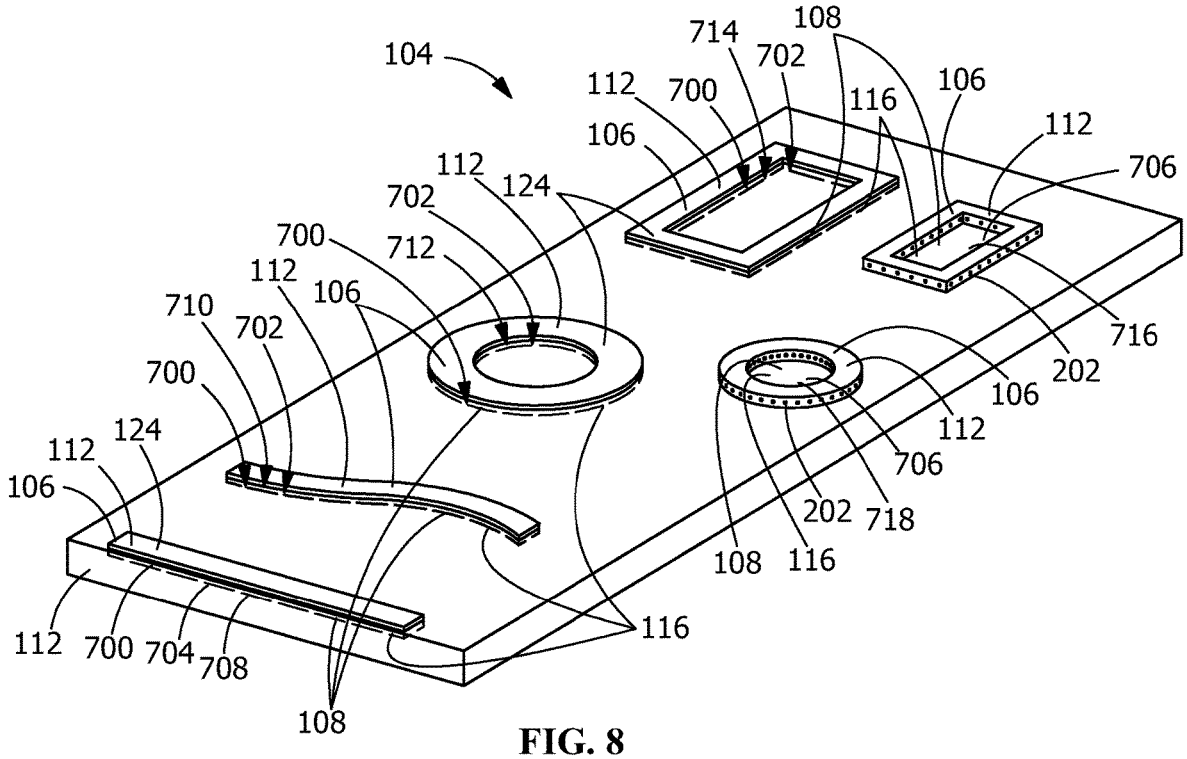
FIG. 8 is a perspective view of the second article, according to an embodiment of the present disclosure.

Referring to FIGS. 7 and 8, the hollow feature 116 may be a channel 700, a closed channel 702, an open channel 704, a pocket 706, or combinations thereof. The channel 700, closed channel 702, open channel 704, or combinations thereof, may be a straight-path channel 708, a curved-path channel 710, an annular-path channel 712 (circular, elliptical, irregular, or combinations thereof), a triangular-path channel (not shown), square-path channel 714, a rectangular-path channel (not shown), or combinations thereof. The pocket 706 may be a triangular pocket (not shown), a square pocket 716, a rectangular pocket (not shown), a circular pocket 718, an elliptical pocket (not shown), an irregular pocket (not shown), or combinations thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus, comprising:

a first article, the first article being a metal and having a first surface;

a second article, the second article being a ceramic matrix composite (CMC) and having a second surface, the second surface facing the first surface across a gap between the first article and the second article;

at least one interface structure extending across the gap between the first article and the second article, the first article and the second article being in contact with one another through the interface structure; and a thermal break directly adjacent to the at least one interface structure, the thermal break interrupting a thermal conduction path through the at least one interface structure between the second article and the first article, wherein, as measured along a cross-section passing through the first article, the second article, the gap, the at least one interface structure, and the thermal break, each of the first article and the second article extends across an entirety of a width of the at least one interface structure and extends further beyond the entirety of the width of the at least one interface structure in at least one direction, and wherein:

the thermal break is disposed between the first article and the second article, the at least one interface structure protruding from at least one of the first article and the second article and surrounding the thermal break on at least two sides of the thermal break, the at least one interface structure being arranged and configured to be actively cooled from the thermal break across the width of the at least one interface structure.

2. The apparatus of claim 1, wherein the apparatus is a turbine component.

3. The apparatus of claim 2, wherein the turbine component is selected from the group consisting of a nozzle, a bucket, a shroud, a combustor, a combustion liner, a transition piece, an exhaust frame, and combinations thereof.

4. The apparatus of claim 1, wherein the metal is selected from the group consisting of iron-based alloys, steels, carbon steels, stainless steels, 9Cr-12Cr stainless steels, nickel-based alloys, cobalt-based alloys, titanium-based alloys, titanium-aluminum alloys, refractory alloys, superalloys, iron-based superalloys, nickel-based superalloys, cobalt-based superalloys, 304SS, 310SS, 410SS, GTD-111, HR-120, INCONEL 718, René N5, René 108, and combinations thereof.

5. The apparatus of claim 1, wherein the CMC is selected from the group consisting of carbon-fiber-reinforced silicon carbides (C/SiC), silicon-carbide-fiber-reinforced silicon carbides (SiC/SiC), carbon-fiber-reinforced silicon nitrides ($C/Si_3N_4$), and combinations thereof.

6. The apparatus of claim 1, wherein the thermal break includes an insulator.

7. The apparatus of claim 6, wherein the insulator is selected from the group consisting of air, static air, flowing air, vacuum, zirconia, silicon nitride, rare earth materials, rare earth oxides, yttria, compressed rare earth oxide powders, and combinations thereof.

8. The apparatus of claim 1, wherein the thermal break includes a hollow feature.

9. The apparatus of claim 8, wherein the hollow feature is selected from the group consisting of a channel, a straight-path channel, a curved-path channel, an annular-path channel, a triangular-path channel, a square-path channel, a rectangular-path channel, a pocket, a triangular pocket, a square pocket, a rectangular pocket, a circular pocket, an elliptical pocket, and combinations thereof.

10. The apparatus of claim 8, wherein the hollow feature is arranged and configured to receive and transmit a flow of a cooling fluid.

11. The apparatus of claim 10, wherein the interface structure includes a plurality of exhaust structures in fluid communication with the hollow feature, the plurality of exhaust structures arranged and configured to receive the flow of cooling fluid from the hollow feature and exhaust the flow of cooling fluid to the gap.

12. The apparatus of claim 11, wherein the plurality of exhaust structures is selected from the group consisting of cooling holes, cooling slots, cooling channels, and combinations thereof.

13. The apparatus of claim 1, wherein the first article directly contacts the second article at the interface structure, and the interface structure is free of thermal barrier coatings and environmental barrier coatings.

14. The apparatus of claim 3, wherein the turbine component is a nozzle.

15. The apparatus of claim 3, wherein the turbine component is a bucket.

16. The apparatus of claim 3, wherein the turbine component is a shroud.

17. The apparatus of claim 3, wherein the turbine component is a transition piece or an exhaust frame.

* * * * *